United States Patent [19]

von Buelow et al.

[11] Patent Number: 4,493,440

[45] Date of Patent: Jan. 15, 1985

[54] WALL-MOUNTED SOAP DISPENSER

[75] Inventors: John von Buelow, Woodland Hills; Stephen G. Hauser, Tarzana, both of Calif.

[73] Assignee: United States Borax & Chemical Corporation, Los Angeles, Calif.

[21] Appl. No.: 521,488

[22] Filed: Aug. 8, 1983

[51] Int. Cl.[3] ..... B67D 1/16; B65D 88/54

[52] U.S. Cl. ..... 222/109; 222/181; 222/309; 222/375; 417/498

[58] Field of Search ..... 222/180, 181, 182, 309, 222/108, 109, 372, 375, 377, 380, 505, 509, 173, 251, 282, 287; 417/498; 403/348, 349, 353, 13, 14, 356

[56] References Cited

U.S. PATENT DOCUMENTS

| | | | |
|---|---|---|---|
| D. 265,795 | 8/1982 | Keith et al. . | |
| 708,652 | 9/1902 | Lee . | |
| 766,624 | 8/1904 | Jarvis . | |
| 804,468 | 11/1905 | Helmold et al. . | |
| 1,110,135 | 9/1914 | Henderson . | |
| 1,158,166 | 10/1915 | Bobrick . | |
| 1,174,674 | 3/1916 | Byer | 417/498 |
| 1,187,474 | 6/1916 | Hollingsworth . | |
| 1,349,121 | 8/1920 | Dabrowski . | |
| 1,455,970 | 12/1920 | Resek . | |
| 1,471,441 | 10/1923 | Berg . | |
| 1,496,549 | 6/1924 | Kooperstein . | |
| 1,559,484 | 10/1925 | Watrous . | |
| 1,567,444 | 5/1926 | Lesmann . | |
| 1,586,397 | 5/1926 | Bobrick . | |
| 1,586,398 | 5/1926 | Bobrick . | |
| 1,618,339 | 2/1927 | Holmes . | |
| 1,633,448 | 6/1927 | Lurcott . | |
| 1,720,044 | 8/1927 | Holmes . | |
| 1,844,557 | 4/1930 | Bobrick . | |
| 1,904,756 | 9/1931 | Wooster . | |
| 2,399,016 | 8/1943 | Gits | 222/153 |
| 2,425,161 | 8/1947 | Opitz . | |
| 2,898,009 | 8/1959 | Green | 222/309 |
| 2,965,267 | 12/1960 | Darr . | |
| 3,141,583 | 7/1964 | Mapel et al. | 222/309 |
| 3,537,620 | 11/1970 | Artmann . | |
| 3,675,499 | 7/1972 | Marosy | 403/348 X |
| 3,920,160 | 11/1975 | Casale et al. . | |
| 4,036,406 | 7/1977 | Jespersen et al. | 222/181 |
| 4,105,146 | 8/1978 | Broillard . | |
| 4,360,130 | 11/1982 | Nishimura et al. | 222/181 X |

*Primary Examiner*—F. J. Bartuska
*Assistant Examiner*—Michael S. Huppert
*Attorney, Agent, or Firm*—Kenneth L. Warsh; Eric P. Schellin; James R. Thornton

[57] ABSTRACT

A wall mounted soap dispenser made of plastic is described. The dispenser includes a hand-operated pump which dispenses liquid soap under pressure and which can be manufactured inexpensively. A disposable container of liquid soap is inserted in the dispenser to refill the dispenser. The pump has on its top a pan to collect liquid spilled as the disposable container is inserted. The pump and container are enclosed in a plastic housing which hinges from a plastic wall plate. A plastic latch with plastic key is used to lock the housing to the wall mounting plate. The pump mechanism uses a piston of two sections of different diameter and corresponding piston chamber of two sections of different diameter. There is an adjustable piston stroke length limiting mechanism. The piston is attached to the lever which moves the piston by means of a crossbar on the end of the piston rod. The crossbar is inserted in a slot in the lever and then turned to cross the slot.

50 Claims, 15 Drawing Figures

FIG. 1
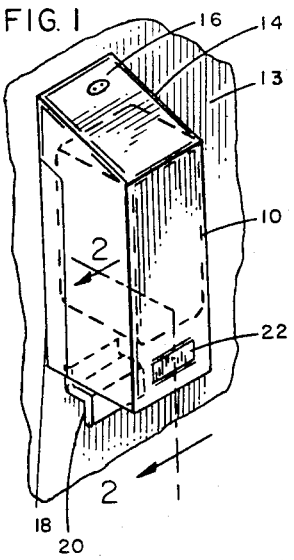
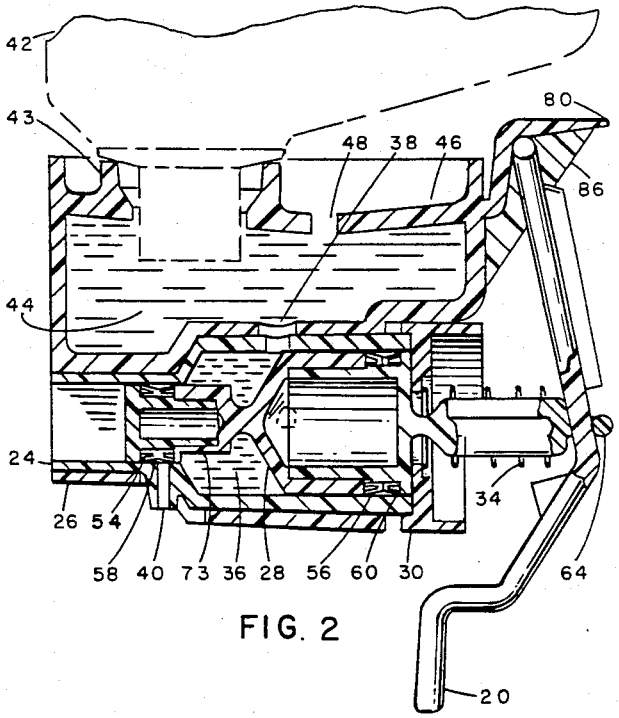
FIG. 2
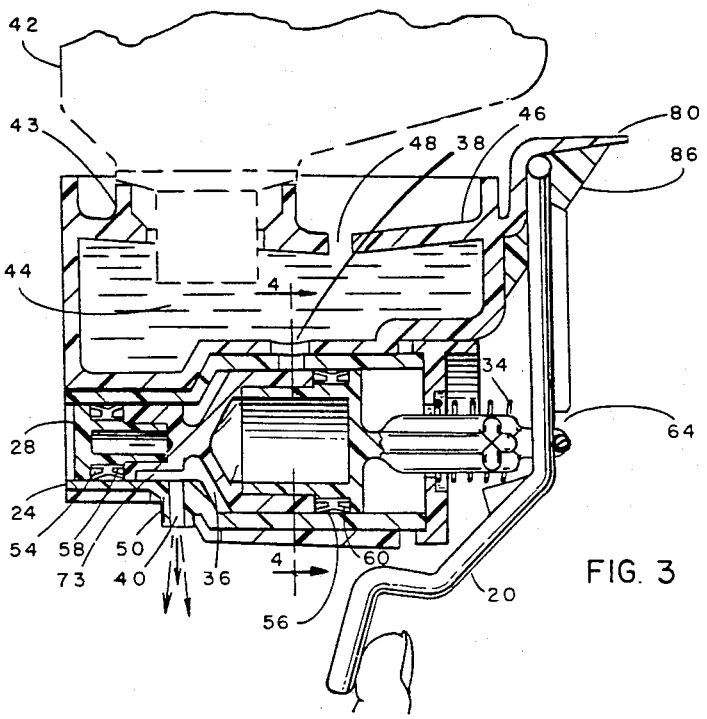
FIG. 3

WALL-MOUNTED SOAP DISPENSER

FIELD OF THE INVENTION

This invention pertains to a wall-mounted dispenser capable of measuring and delivering into the hand of the user small uniform quantities of liquids and semi-liquids such as soaps, creams, pastes and lubricants.

BACKGROUND OF THE INVENTION

In workshops, laboratories, repair shops and similar working zones, clean-up areas have been set aside. Such clean-up rooms are frequented by many individuals who require access to cleansing material. Providing soap and detergent bars for multiple use poses many problems as many individuals dislike employing a soap bar which had been used only a short time before by someone else, who may leave a wet soggy soap bar. To obviate this problem to a degree, powdered soap dispensers have been provided. These powdered soap dispensers are not usually useful in dispensing a paste material, as the powdered soap dispensers usually depend upon gravity flow for succesful operation. Unless there is provision for positive pumping action the paste, if very viscous, will be dispensed at an extremely slow rate, if at all.

Cleansing paste or liquid has certain advantages over the powdered soap. For instance, powdered soap may cake in the hands and may require vigorous rubbing with water before it becomes solubilized and loses its grittiness. On the other hand, cleansing paste or liquid is usually already partially emulsified in a diluent resulting in quick further dispersal. Instead of dispensing cleansing paste, it is oftentimes desirable to provide for small quantities of a lotion material which is applied to the hands as a protection and barrier to dirt.

PRIOR PRACTICE

In the prior art devices, when dispensing paste, there is often no positive pumping action, and so a complex follower and pressurizing system is required. The pressurizing is usually accomplished by a floating piston which is spring urged to compress the paste. It will be appreciated that such means will result in mechanical difficulties and is subject to undue wear and fairly rapid breakdown.

Wall-mounted containers for fluid soap which dispense a fixed volume using gravity flow are old in the art. See, for example, U.S. Pat. No. 1,496,649 to Kooperstein. Such dispenser requires frequent cleaning as the dispensing opening is easily clogged with dried soap. Dispensing the soap under pressure would keep the opening clear.

To eliminate the problem of clogged dispensing opening, air-tight dispensers have been produced provided with a pump having a cylindrical body, a slide member defining at least two chambers inside which the movement of the slide member alternately creates compression and reduced pressure allowing the suction of the product and cleaning of the ejection orifice. It has been found that if such metering devices are theoretically perfect, in fact they have numerous practical drawbacks. The sliding member and pump body, made from different materials, have different coefficients of expansion. The result of this is that the seal between the lateral walls of the slide member on the one hand and of the pump body on the other hand is uncertain, such that as it dries between the two walls, a film of product prevents the sliding of the slide member. In addition, the machining of the sliding piston must be very accurate, of the order of 1/100 of a millimeter, which makes the latter an expensive part.

U.S. Pat. No. 4,360,130 to Nishimura et al discloses a device which ejects liquid soap from the dispenser under pressure but requires pressure-sensitive one-way valves between the reservoir and the measuring volume and between the measuring volume and the dispensing opening.

U.S. Pat. No. 1,174,674 to Byer discloses a dispenser for fluids which uses the force of a user on a plunger to dispense a measured quantity of liquid rather the force of gravity. This invention is an improvement on the principle of using gravity to dispense the fluid and is simpler than the Nishimura patent in that it does not need one-way valves. The metal and glass construction of the Byer patent, however, presents all the problems of different coefficients of expansion, drying of the liquid and machining accuracy discussed above.

U.S. Pat. No. 4,105,146 to Broillard describes a liquid soap dispenser which incorporates a disposable container of fluid soap into the dispenser. A lever and single piston is used to dispense the fluid soap under pressure. The piston is a single diameter device which requires the fluid to pass through a small borehole in the piston from the measuring chamber to the discharge. This borehole poses manufacturing difficulties and has the potential for clogging when thicker fluids or pastes are used. The volume discharged is dependent on the length of the stroke of the piston. The discharge volume is not adjustable.

All of the prior art, therefore has limitations of function, poses significant manufacturing and maintenance difficulties, and is expensive to manufacture and maintain.

SUMMARY OF THE INVENTION

The aims of this invention are to define a wall-mounted dispenser for fluid soap and the like which dispenses a small fixed volume of liquid or paste under pressure, keeping the construction so simple that the dispenser can be made of inexpensive molded plastic parts with no hand machining and with a minimum of metal parts, and keeping the dispenser easy to maintain.

A further aim of this invention is to make the discharge volume repeatable by the user, but easily adjustable by maintenance personnel. The new invention should be less likely to leak fluids and less likely to plug up with dried fluids than the prior art.

These objects are achieved by housing the dispenser in a smooth plastic housing which is inexpensive and easily cleaned. The pump assembly and the reservoir are molded of plastic and snap into the housing. A lever mounted under the dispenser is used to push a plastic piston into a pump chamber. The motion of the piston disconnects the pump chamber from the reservoir and opens a channel to the dispensing opening. The force of the piston expels the fluid.

A disposable container of liquid is dropped into the dispenser and replaced when empty making refilling the dispenser simple. The disclosure of the U.S. Pat. No. Des. 265,795 to Keith for this disposable container is hereby incorporated by reference. The entire pump mechanism snaps apart without the use of tools making cleaning accidentally introduced foreign matter out of the pumping mechanism a simple matter. Parts of the mechanism are keyed to make correct reassembly obvious and certain.

The housing of the dispenser has a sloping top to prevent placing cigarettes on the top and thereby damaging the container. A simple plastic lock on the top receiving a simple plastic key prevents unauthorized persons from opening the dispenser. When the user of the key unlocks the dispenser the front and sides of the dispenser cover pivot near the bottom revealing the disposable container and the pumping mechanism. A small transparent window on the front of the dispenser housing allows viewing the mechanism.

A broad lever is placed under the dispenser so that the user naturally places the tips of his fingers under the lever palm up. As the lever is pulled toward the user with the tips of the fingers the liquid thus dispensed drops into the palm of the hand of the user.

Gaskets are used to seal the ends of the piston into the pump chamber, allowing significant clearance between the piston and the pump chamber. The motion of the gaskets along the wall of the pump chamber as the piston is moved serve to seal the liquid within desirable bounds and prevent leaking and also to wipe the walls of the piston chamber clean of soap thereby preventing soap from drying on the walls and causing problems. Because all parts are plastic there is no problem with different coefficients of expansion. Because the gaskets allow significant clearance between the walls of the chamber and the piston, the plastic parts can be molded rather than machined. There is no need to drill holes through the piston.

A ring in the pumping mechanism can be set to one of three different positions by hand by maintenance personnel in order to set one of three different discharge volumes.

As the lever is released after discharge of the fluid a lowered pressure is created within the measuring pump chamber thereby recharging the measuring volume under pressure and clearing the dispensing nipple by snuffing back the fluid.

In the preferred embodiment all parts except a standard metal spring are made of molded plastic. A plastic spring means can be substituted if desired.

These and further constructional and operational characteristics of the invention will be more evident from the detailed description given hereinafter with reference to the figures of the accompanying drawings which illustrate one preferred embodiment by way of non-limiting example.

BRIEF DESCRIPTION OF THE DRAWINGS

FIG. 1 is a perspective view of the dispenser mounted on the wall.

FIG. 2 is a cross-section of the pump in the resting position along the line 2—2 in FIG. 1.

FIG. 3 is a cross-section of the pump in the position of full stroke of the pump.

DESCRIPTION OF THE PREFERRED EMBODIMENT

Figure 6:
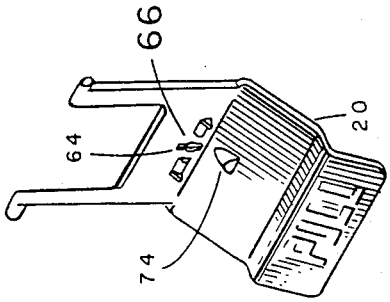
FIG. 6 is a view of the stroke adjuster ring.
Figure 6:
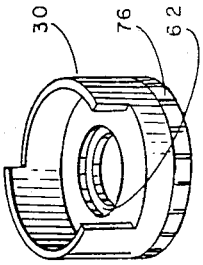

Referring now to the drawings wherein reference numerals are used to designate parts throughout the various figures thereof, there is shown in FIG. 1 a perspective view of the dispenser 10 attached to the wall 13. The dispenser has a hinged cover 14, a lock 16 used to secure the hinged cover 14 to the wall plate 18, a lever 20, and a viewing window 22. The hinged cover 14 has a sloping top to preclude placing lighted cigarettes on it.

Figure 5:
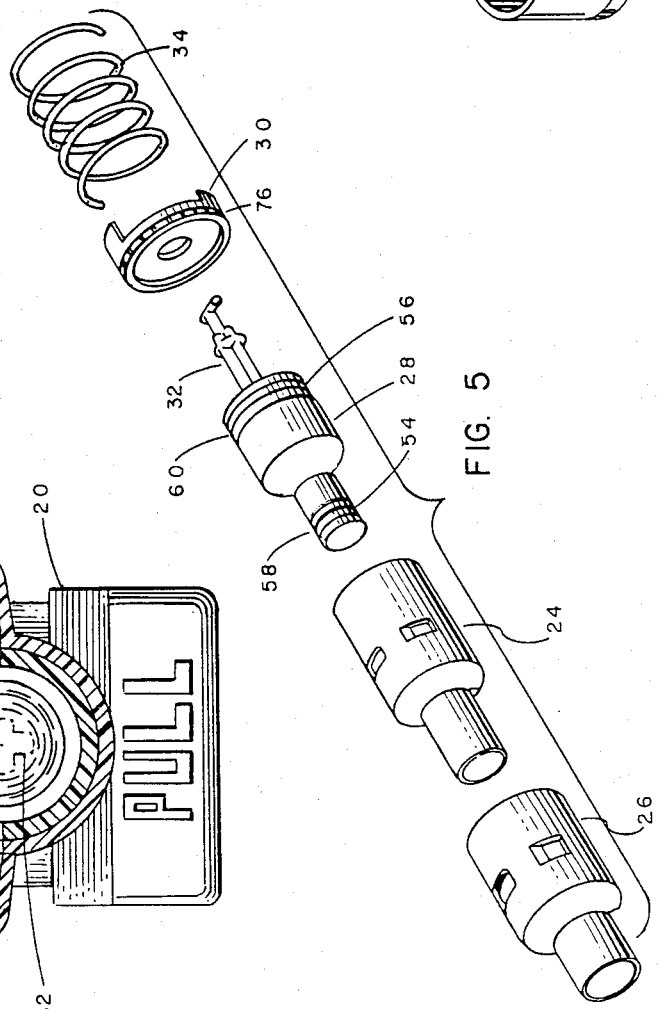
FIG. 5 is an exploded view of the piston assembly.
Figure 4:
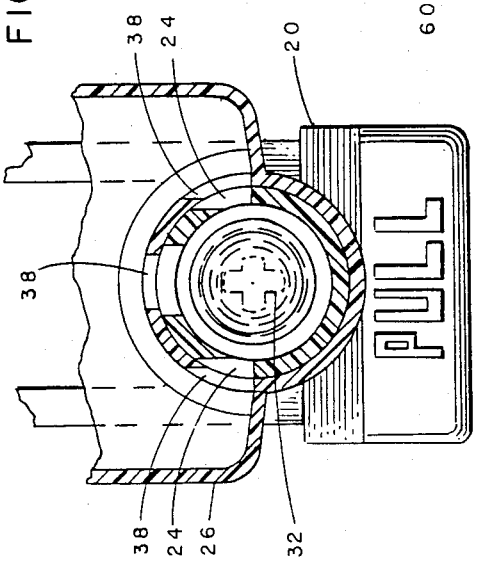
FIG. 4 is a section through line 4—4 on FIG. 3.

The pump assembly for the dispenser can be seen in cross-section at rest in FIG. 2, in full stroke position in FIG. 3, in section through the piston in FIG. 4 and with an exploded view of the piston in FIG. 5. In FIG. 5 it can be seen that the pump chamber 24 fits into the pump housing 26. Only a part of the pump housing 26 is shown in FIG. 5 for clarity. The pump housing 26 is made of transparent plastic so that the level of subject liquid may be seen through the window in the corner. The piston 28 fits into the pump chamber 24. The stroke adjuster ring 30 fits over the piston rod 32. The spring 34 fits over the piston rod 32 and abuts the stroke adjuster ring 30. When the piston rod is locked into the lever 20, the spring 34 abuts the lever 20.

The piston 28 has two cylindrical segments of different diameter. When assembled into the dispenser 10 the smaller diameter segment is nearer the front of the dispenser 10 and the larger diameter segment is nearer the rear and has the piston rod 32 attached to it.

Figure 15:
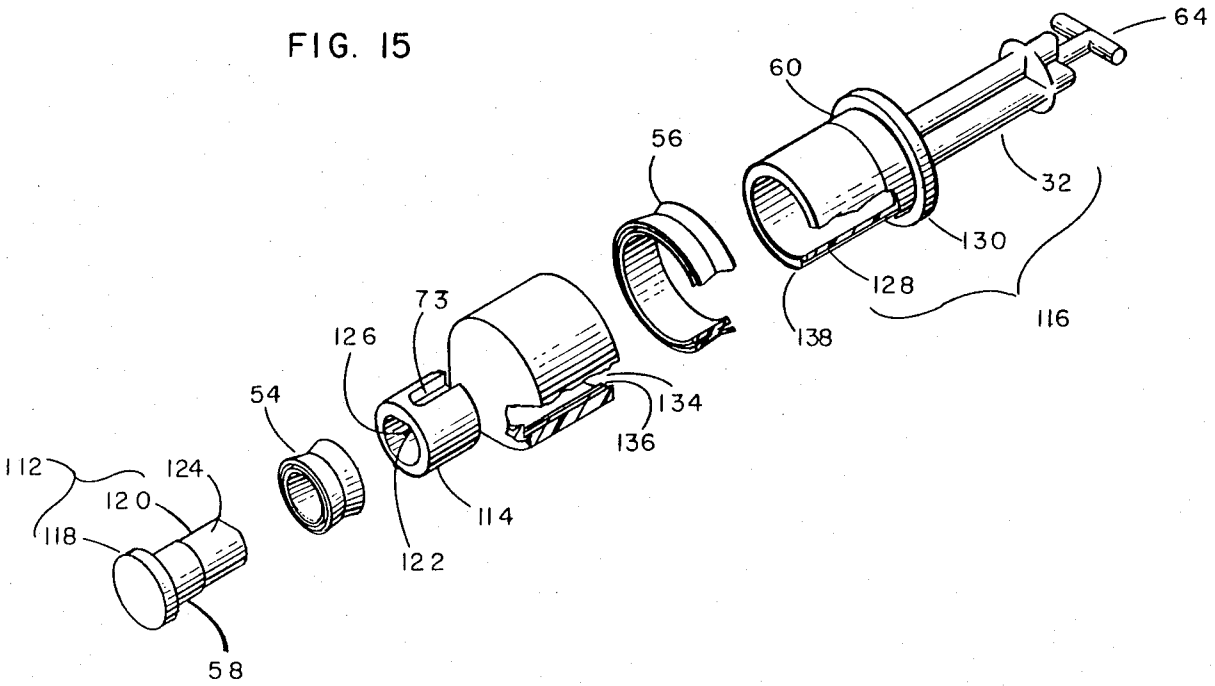
FIG. 15 shows an exploded view of the construction of the piston.

The piston 28 is provided with X-gaskets 54 and 56 which fit into grooves 58 and 60 formed in the piston 28. This is shown in FIGS. 2, 3 and 5. The X-gaskets are a modified "I" shape in cross-section, with the end in the bottom of the groove having the normal "T" end of an "I" and the end at the top of the groove has its "T" modified more like a "Y" as shown in FIGS. 2, 3 and 15.

Figure 8:
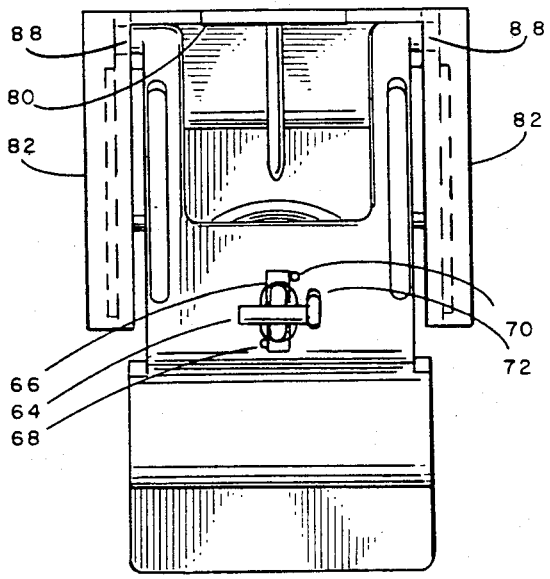
FIG. 8 is a view of the pump assembly viewed from the rear turned upside-down.

The piston rod 32 has an X-shaped cross-section as shown in FIG. 4 for lightness and strength. The stroke adjuster ring 30 has a shoulder 62 formed in it to seat the spring 34 as shown in FIG. 6. The piston rod 32 has a crossbar 64 on the end in order to lock the piston rod 32 to the lever 20. The crossbar 64 is not symmetrical; rather one side of the crossbar 64 is longer than the other corresponding to an asymmetrical slot 66 in the lever 20. The arrangement of asymmetrical crossbar 64 and asymmetrical slot 66 guarantees a unique orientation of the piston 28 during assembly as shown in FIG. 8. Bumpers 68 and 70 on the back of the lever provide means to require that the piston 28 be rotated in a unique direction as it is locked in place. The piston 28 must be rotated through 90 degrees so that the shorter end of the crossbar 64 rests against the stop 72. This construction guarantees the alignment of the piston 28 so that the notch 73 in the piston 28 faces downward when mounted in the dispenser 10. In an alternate embodiment the notch 73 is formed twice on opposite sides of the cylinder so that it is not necessary to maintain a unique alignment. In this embodiment the crossbar 64 and the slot 66 can be symmetrical.

In FIG. 2 the spring 34 is shown pushing against the stroke adjusting ring 30 and the lever 20 to move the piston 28 toward the rear of the dispenser 10 forming the measuring annulus 36. As the piston 28 is drawn to the rear of the dispenser 10, a reduced pressure is formed in the measuring annulus 36; the reduced pressure draws the subject fluid from the upper part of the pump housing 26 into the measuring annulus 36 through the connecting opening 38. There may be more than one such connecting opening 38 and it may be placed either at the top as shown in the Figures or at the sides. As the piston 20 is drawn toward the front of the dispenser 10 by the user's hand as shown in FIG. 3, the piston 28 is moved toward the front of the dispenser 10. First the motion of the piston 28 cuts off the connecting opening(s) 38 from the measuring annulus 36 and then the motion opens the dispensing opening 40. Further motion forces the subject fluid through the dispensing opening 40 under pressure.

In FIGS. 2 and 3 the neck of the disposable bottle 42 is shown sitting in the pump housing 26, the fluid flows from the bottle 42 through an inlet 43 into the reservoir 44 under the force of gravity. Any spillage which might have occurred at the time the disposable bottle 42 was installed is collected in the pan 46 at the top of the pump housing 26. The liquid in the pan 46 then drains into the reservoir 44 through the drain hole 48.

Figure 7:
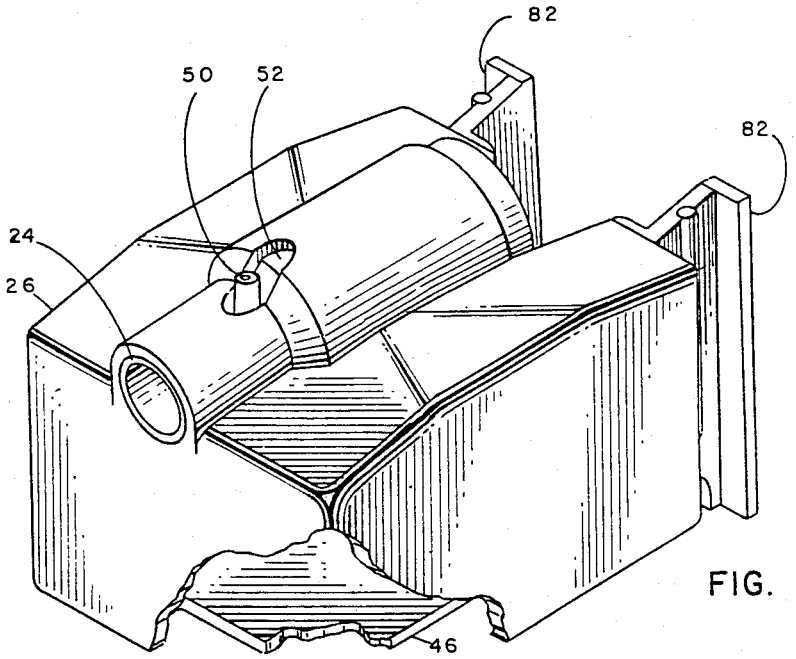
FIG. 7 is a view of the underside of the dispenser showing the dispensing opening.

The connecting opening(s) 38 must be formed in the same positions in the pump chamber 24 and pump housing 26 into order to form a connecting passageway. A dispensing nipple 50 is formed on the pump chamber 24 and the dispensing opening 40 is formed through this dispensing nipple 50 as shown in FIG. 7. A slot 52 is cut in the pump housing 26 so that the dispensing nipple 50 is keyed into the slot. This keying of the dispensing nipple 50 into the slot 52 restricts assembly of the pump chamber 24 and pump housing 26 to a unique orientation thereby providing alignment for the connecting opening(s) 38.

The stroke adjusting ring 30 has three different regions of length as shown in FIG. 6. The lever 20 has a contact 74 which touches the stroke adjusting ring 30 at full stroke. The stroke adjusting ring 30 can be rotated by grasping the ring 30 at the knurled region 76 to align one of the three different lengths to correspond to the contact 74 thereby limiting the stroke of the piston 28 to one of three different stroke lengths. The three different stroke lengths, of course, discharge three different amounts of the subject fluid. The lever 20 might have the instruction "PULL" formed into or imprinted on its front surface to guide the user in its use.

Figure 9:
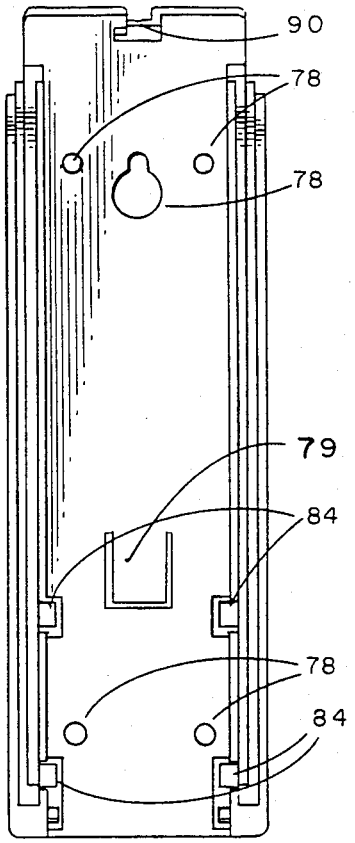
FIG. 9 is a view of the dispenser from the rear.
Figure 10:
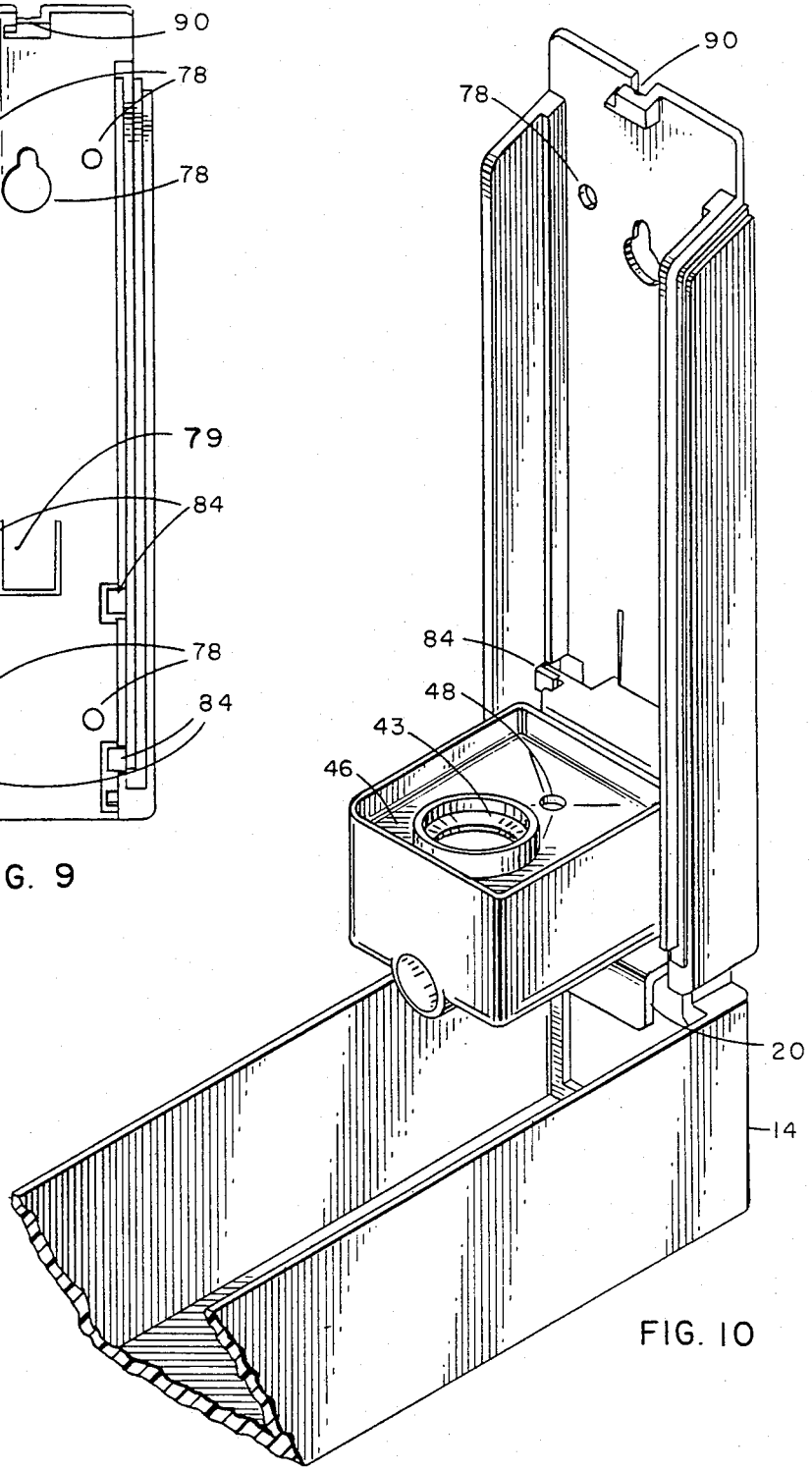
FIG. 10 is a quarter view of the dispenser from the front with the cover opened.

The wall plate 18 has mounting holes 78 for mounting the dispenser on the wall as shown in FIG. 9. A locking tab 79 in the wall plate 18 operates together with a tab 80 on the rear of the pump housing 26 to hold the pump housing 26 when it is slid into place. There are rails 82 on the sides of the pump housing 26 which slide over flanges 84 to attach the pump housing 26 to the wall plate 18. There is a gusset 86 under the tab 80 for strength. The lever 20 pivots in pivot holes 88 in the pump housing 26.

Figure 12:
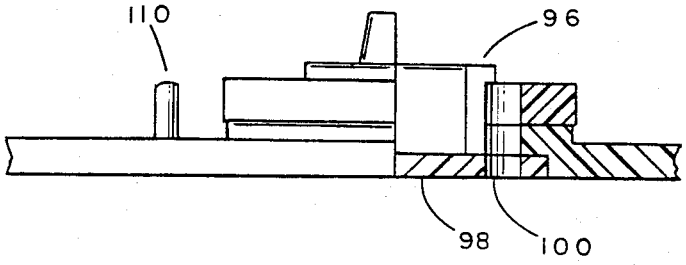
FIG. 12 is a view of the lock cylinder through the line 12—12 on FIG. 11.
Figure 11:
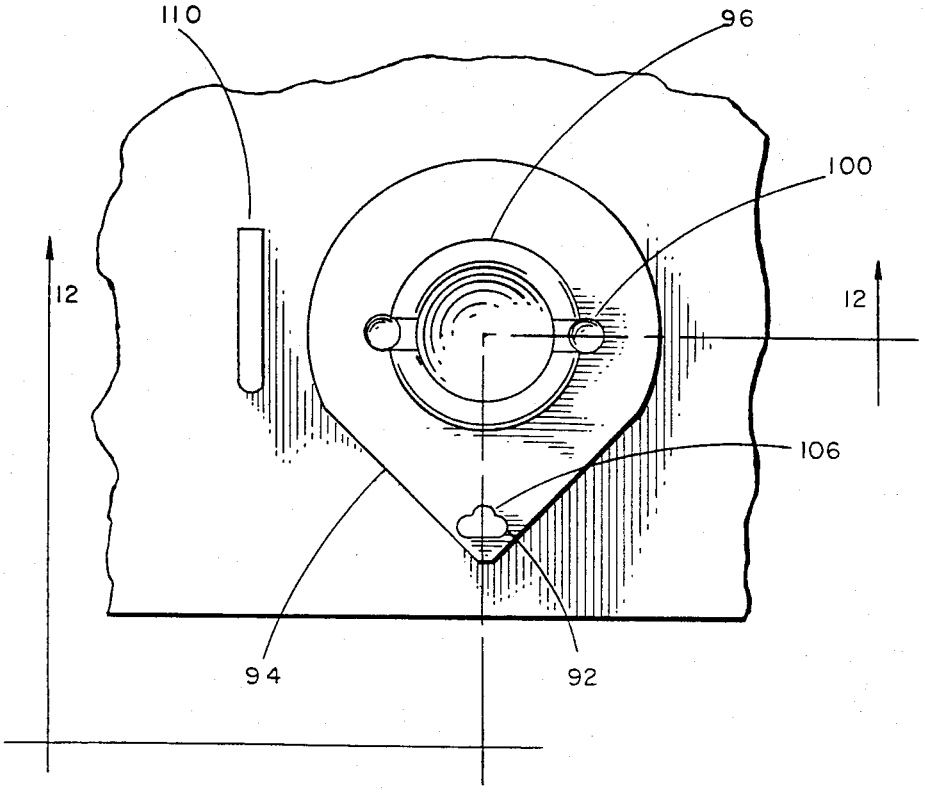
FIG. 11 is a top view of the lock cylinder.
Figure 13:
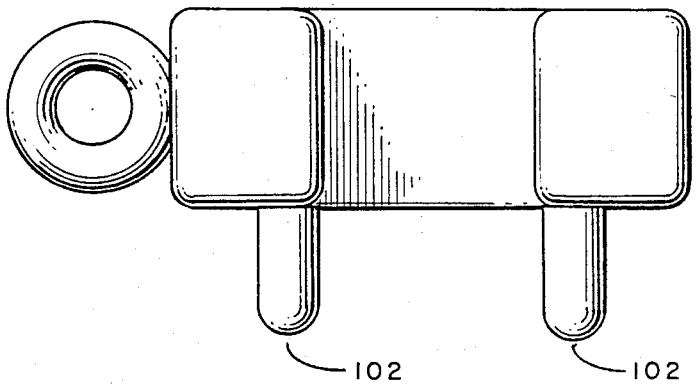
FIG. 13 shows the key used with the lock.
Figure 14:
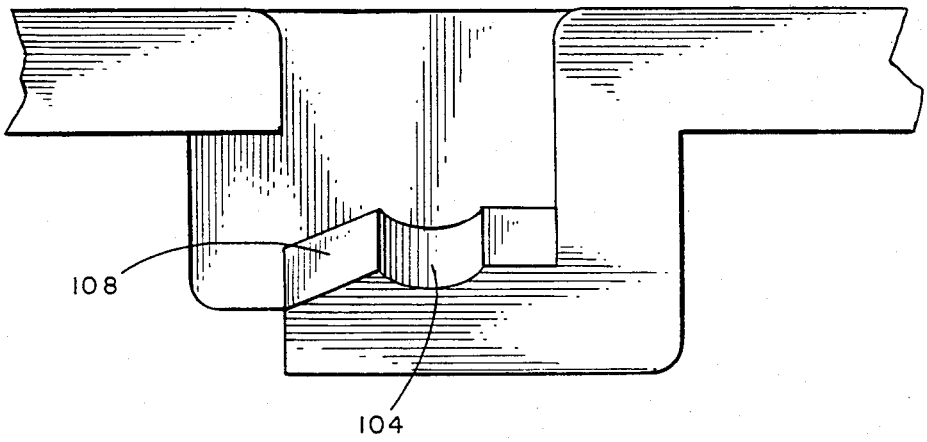
FIG. 14 shows a detail of the strike plate of the lock.

There is a strike plate 90 at the top of the wall plate 18 which forms part of the lock 16. The bolt 92 of the lock 16 is shown in FIGS. 11 and 12. The bolt 92 is formed on a plate 94 which fit under a lip on a cylinder 96 which in turn passes through a hole in the hinged cover 14. On the top of the hinged cover a circular plate 98 is formed as part of the cylinder 96. Two holes 100 are formed in the plate 98—cylinder 96 assembly and continued through into the plate 94. A key as shown in FIG. 13 is formed with two rods 102 which are inserted in the holes 100 to operate the lock 16. As shown in FIG. 14 the strike plate 90 has a depression 104 which interlocks with the bump 106 on the bolt. A taper 108 on the strike plate 90 serve to guide the bolt into place. There is a detent 110 to prevent turning the lock 16 too far.

The piston 28 is made of three parts as shown in FIG. 15. The piston cap 112 is inserted into the piston cylinder 114 from the front end. The piston base 116 is inserted into the piston cylinder 114 from the rear end. These three parts are held together by friction fit. The piston cap 112 can be described as a disk 118 on the end of a small hollow cylinder 120. The hole 122 in the front of the piston cylinder 114 is formed to accept the cylinder 120 in a snug fit, but the hole 122 is not so deep as to accept the whole length of the cylinder 120. The remaining part of the small hollow cylinder 120 exposed to view when the piston cap 112 is assembled into the piston cylinder 114 forms the groove 58 for the X-gasket 54. A flat 124 is formed on the cylinder 120 so that a corresponding flat 126 may be formed in the hole 122. This flat 126 thickens the wall of the piston cylinder 124 where the notch 73 is cut. The piston base 116 might be described as a large hollow cylinder 128, to which is attached a disk 130, to which is attached a piston rod 32. The cylinder 128 fits into the large hold 134 at the rear of the piston cylinder 114. The hole 134 is not so deep as to accept the whole length of the cylinder 128. The remaining part of the large hollow cylinder 128 exposed to view when the piston base 116 is assembled into the piston cylinder 114 forms the groove 60 for the X-gasket 56. A tongue 136 is formed inside the hole 134 to mate to a groove 138 on the outside of the cylinder 128. The tongue 136 and groove 138 provide a means of uniquely orienting the piston base 116 to the piston cylinder 116 thereby preserving the alignment of the notch 73 to the crossbar 64. The three piece construction of the piston 28 thus produces a strong hollow, lightweight assembly which fits together in such a way to provide grooves for X-gaskets which in turn allow low precision manufacturing techniques such as injection molding of thermoplastics. The piston 28 has been shown as cylindrical in cross-section. It is obvious to a practioner of the art that this cross-section could be other such as elliptical or eggshaped.

The piston cap 112, the X-gasket together with the forward part of the piston cylinder 114 constitute a smaller piston segment. The rear part of the piston cylinder 114, the X-gasket 56, the large hollow cylinder 128 and the disk 130 constitute a larger piston segment. The corresponding segments of the pump chamber 24 into which the small piston segment and the large piston segment fit are, respectively, the small chamber segment and large chamber segment.

The stroke adjuster ring 30 has been shown with 3 segments of different cylindrical length. There may be many such segments or the cylindrical length can be formed to continuously vary, forming a spiral on the surface against which the contact 74 stops.

All parts are made of plastic except the string. The pump housing 26 and the viewing window 22 are transparent plastic. All other plastic parts may be opaque and any color suitable. The spring can be a standard metal spring or a plastic spring means may be used if desired.

This invention is not limited to the preferred embodiment and alternatives heretofore described, to which variations and improvements may be made, consisting of mechanically equivalent modifications to component parts, without leaving the scope of protection of the present patent, the characteristics of which are summarized in the following claims.

What is claimed is:

1. A dispenser for liquids, pastes, and creams capable of being mounted on a vertical surface comprising:

a manual pumping mechanism including, a pump housing providing a reservoir for liquid, a pump chamber within said pump housing having at least one connecting opening to said reservoir, having a smaller chamber segment nearer the front of said mechanism and a larger chamber segment behind and co-axial with said smaller chamber segment, having a dispensing opening in said smaller chamber segment, a piston having a smaller piston segment and a larger piston segment behind and co-axial with said smaller piston segment, having a piston rod on the end of and co-axial with said larger piston segment, having grooves on each of said piston segments with gaskets fit into said grooves so as to form a sliding-contact fit between said chamber segments and said piston segments, said piston rod having at its end a crossbar, a lever pivoted at its upper end from the rear side of said pump housing and attached near its middle to said piston rod, said lever having a slot adapted and constructed to fit said piston into said lever, said crossbar having a flat at one end, said lever having a stop on its back side adapted and constructed so that after inserting said crossbar through said slot and rotating said crossbar by ninety degrees, said flat rests against said stop, a spring means forcing said lever toward the rear of said dispenser, and a means for attaching said mechanism to a vertical surface.

2. A dispenser as in claim 1 where said two segments of said pump chamber are cylindrical segments of different diameter and said two segments of said piston are cylindrical segments of different diameter.

3. A dispenser as in claim 2 where said piston includes a piston cylinder, a piston cap, and a piston base.

4. A dispenser as in claim 3 where said piston cylinder, piston cap and piston base are so formed as to make said piston hollow when assembled.

5. A dispenser as in claim 3 where said piston cylinder, piston cap and piston base are constructed and adapted as to form said gasket grooves in the joints between said piston cylinder, piston cap and piston base.

6. A dispenser as in claim 1 where said means for attaching said mechanisms to said vertical surface is a plate having holes formed in it through which fastening means can be attached to said vertical surface, said plate having means to hold said manual pumping mechanism.

7. A dispenser as in claim 6 where said means to hold said manual pumping mechanism includes rails on the rear of said pump housing which cooperate with flanges on said plate adapted and constructed so that said pump mechanism can be slid off said plate for servicing or cleaning.

8. A dispenser as in claim 7 additionally comprising a tab on said pump housing cooperating with a locking tab on said plate adapted and constructed to lock said pump mechanism in place on said plate.

9. A dispenser as in claim 8 additionally comprising a gusset under said tab adapted and constructed to strengthen said tab.

10. A dispenser as claim 1 additionally comprising a covering means over said pumping mechanism and said means for attaching dispenser.

11. A dispenser as in claim 10 where said covering means has a transparent window whereby to view the liquid level.

12. A dispenser as in claim 10 where said covering means is hinged to said means for attaching.

13. A dispenser as in claim 12 where said covering means is hinged at the bottom of said covering means.

14. A dispenser as in claim 13 where said hinged covering means has near its top latching means to said attaching means.

15. A dispenser as in claim 14 where said latching means includes a lock and key.

16. A dispenser as in claim 15 where said key cooperating with said lock is a bar supporting two parallel rods whereby inserting said two rods into said lock allows the user to open or close said lock.

17. A dispenser as in claim 10 where said covering means has a sloping top whereby to prevent holding objects placed on the top of said covering means.

18. A dispenser as in claim 1 where said gaskets are X-gaskets.

19. A dispenser as in claim 1 additionally comprising a stroke adjuster means whereby the length of the stroke of said piston is adjusted.

20. A dispenser as in claim 19 where said stroke adjusting means comprises a cylindrical ring fitting around said piston rod having segments of different cylindrical length.

21. A dispenser as in claim 20 where said stroke adjusting means has three segments of different cylindrical length.

22. A dispenser as in claim 20 where said cylindrical ring has a knurled region on the outside of said ring whereby to facilitate the finger grip of the user.

23. A dispenser as in claim 1 where said pump housing has on its top an inlet means for liquid.

24. A dispenser as in claim 23 where said inlet means is adapted and constructed to receive and support the neck of a bottle of said subject liquid, said bottle resting on top of said pump housing.

25. A dispenser as in claim 23 where the top of said pump housing is shaped as a pan adapted and constructed to hold spilled liquids.

26. A dispenser as in claim 25 where said pan has a drain hole adapted and constructed to pass spilled liquids from said pan into said reservoir.

27. A dispenser as in claim 1 additionally comprising bumpers on the back of said lever adapted and constructed to require that the direction of rotation of said crossbar be the shortest path to said stop.

28. A manual pumping mechanism for dispensing liquids, pastes, and creams comprising:

a pump housing providing a reservoir for liquid;

a pump chamber within said pump housing having at least one connecting opening to said reservoir, having a smaller chamber segment nearer the front of said mechanism and a larger chamber segment behind and co-axial with said smaller chamber segment, having a dispensing opening in said smaller chamber segment;

a piston having a smaller piston segment and a larger piston segment behind and co-axial with said smaller piston segment, having a piston rod on the end of and co-axial with said larger piston segment, having grooves on each of said piston segments with gaskets fit into said grooves so as to form a sliding-contact fit between said chamber segments and said piston segments, said piston rod having on its end a crossbar;

a lever pivoted at its upper end from the rear side of said pump housing and attached near its middle to said piston rod, said lever having a slot adapted and constructed to fit said piston into said lever, said crossbar having a flat on one end, said lever having a stop on its back side adapted and constructed so that after inserting said crossbar through said slot and rotating said crossbar by ninety degrees said flat rests against said stop; and a spring means forcing said lever toward the rear of said dispenser.

29. A manual pumping mechanism as in claim 28 where said two segments of said pump chamber are cylindrical segments of different diameter and said two segments of said piston are cylindrical segments of different diameter fitting into said cylindrical segments in said pump chamber.

30. A manual pumping mechanism as in claim 29 where said piston includes a piston cylinder, a piston cap and a piston base.

31. A manual pumping mechanism as in claim 30 where said piston cylinder, piston cap and piston base are so formed as to make said piston hollow when assembled.

32. A manual pumping mechanism as in claim 30 where said piston cylinder, piston cap and piston base are adapted and constructed to form said gasket grooves in the joints between said piston cylinder, piston cap and piston base.

33. A manual pumping mechanism as in claim 30 where said piston cylinder, piston cap and piston base are made of plastic.

34. A manual pumping mechanism as in claim 28 where said gaskets are X-gaskets.

35. A manual pumping mechanism as in claim 28 additionally comprising a stroke adjusting means whereby the length of the stroke of said piston is adjusted.

36. A manual pumping mechanism as in claim 35 where said stroke adjusting means comprises a cylindrical ring fitting around said piston rod having segments of different cylindrical length.

37. A manual pumping mechanism as in claim 36 where said stroke adjusting means has three segments of different cylindrical length.

38. A manual pumping mechanism as in claim 28 where said pump housing has on its top an inlet means for liquid.

39. A manual pumping mechanism as in claim 38 where said inlet means is adapted and constructed to receive and support the neck of a bottle of said subject liquid, said bottle resting on the top of said pump housing.

40. A manual pumping mechanism as in claim 28 where the top of said pump housing is shaped as a pan adapted and constructed to hold spilled liquids.

41. A manual pumping mechanism as in claim 40 where said pan has a drain hole adapted and constructed to pass spilled liquids from said pan into said reservoir.

42. A manual pumping mechanism as in claim 28 additionally comprising bumpers on the back of said lever adapted and constructed to require that the direction of rotation of said crossbar be the shortest path to said stop.

43. A dispenser for liquids, pastes and creams capable of being mounted on a vertical surface comprising:

a pump housing providing a reservoir for liquid, having the top of said pump housing shaped as a pan adapted and constructed to hold spilled liquids, having a drain hole in said pan adapted and constructed to pass spilled liquids from said pan into said reservoir, having an inlet on the top of said pump housing adapted and constructed to receive and support the neck of a bottle of said liquid, said bottle resting on the top of said pump housing;

a pump chamber within said pump housing having at least one connecting opening to said reservoir, having a smaller cylindrical chamber segment nearer the front of said pump housing and a larger cylindrical chamber segment behind and co-axial with said smaller chamber segment, having a dispensing opening in said smaller chamber segment;

a piston having a smaller cylindrical piston segment and a larger cylindrical piston segment behind and co-axial with said smaller piston segment, having a piston rod on the end of and co-axial with said larger piston segment, having grooves on each of said piston segments with X-gaskets fit into said grooves so as to form a sliding-contact fit between said cylinder segments and said piston segments, said piston includes a piston cap, piston cylinder and piston base adapted and constructed to form said grooves for X-rings in the joints between said piston cap, piston cylinder and piston base, there being a notch in said smaller piston segment adapted and constructed to facilitate dispensing subject liquid through said dispensing opening, there being a tongue inside said piston cylinder and a groove outside said piston base adapted and constructed to maintain a unique alignment between said piston rod and said notch;

a lever pivoted at its upper end from the rear side of said pump housing and attached near its middle to said piston rod, said piston rod having at its end a crossbar and said lever had a slot adapted and constructed to fit said piston into said lever, where there is a flat on the end of said crossbar and a stop on the back side of said lever adapted and constructed so that, after inserting said crossbar through said slot and rotating said crossbar by ninety degrees, said flat rests against said stop;

a spring forcing said lever toward the rear of said dispenser;

a stroke adjusting cylindrical ring fitting around said piston rod and having three segments of different cylindrical length;

a plate adapted and constructed to detachably hold said pump housing and to be attached to a vertical surface; and a hinged cover with latch which fits over said plate, said pump housing and said bottle.

44. A dispenser for liquids, pastes, and creams capable of being mounted on a vertical surface comprising:

a manual pumping mechanism including, a pump housing providing a reservoir for liquid, a pump chamber within said pump housing having at least one connecting opening to said reservoir, having a smaller chamber segment nearer the front of said mechanism and a larger chamber segment behind and co-axial with said smaller chamber segment, having a dispensing opening in said smaller chamber segment, a piston having a smaller piston segment and a larger piston segment behind and co-axial with said smaller piston segment, having a piston rod on the end of and co-axial with said larger piston segment, having grooves on each of said piston segments with gaskets fit into said grooves so as to form a sliding-contact fit between said chamber segments and said piston segments, said smaller piston segment having a notch adapted and constructed to facilitate dispensing subject liquid through said dispensing opening, said piston further including a piston cylinder, a piston cap and a piston base so formed as the make said piston hollow when assembled, there being a tongue inside said piston cylinder fitting into a groove outside said piston adapted and constructed to maintain a unique alignment between said piston rod and said notch, a lever pivoted at its upper end from the rear side of said pump housing and attached near its middle to said piston rod, a spring means forcing said lever toward the rear of said dispenser, and a means for attaching said mechanism to a vertical surface.

45. A dispenser as in claim 44 where said two segments of said pump chamber are cylindrical segments of different diameter and said two segments of said piston are cylindrical segments of different diameter.

46. A dispenser as in claim 44 where said means for attaching said mechanisms to said vertical surface is a plate having holes formed in it through which fastening means can be attached to said vertical surface, said plate having means to hold said manual pumping mechanism.

47. A dispenser as in claim 44 additionally comprising a covering means over said pumping mechanism and said means for attaching dispenser.

48. A dispenser as in claim 44 where said gaskets are X-gaskets.

49. A dispenser as in claim 44 additionally comprising a stroke adjuster means whereby the length of the stroke of said piston is adjusted.

50. A dispenser as in claim 44 where said pump housing has on its top an inlet means for liquid.

* * * * *